US006684444B2

(12) United States Patent
Wheeler et al.

(10) Patent No.: US 6,684,444 B2
(45) Date of Patent: Feb. 3, 2004

(54) FOOT SCRUBBING AND MASSAGING DEVICE

(75) Inventors: Todd Wheeler, Clearfield, UT (US); David Muskovitz, Park City, UT (US)

(73) Assignee: Accurva, LLC, Layton, UT (US)

( * ) Notice: Subject to any disclaimer, the term of this patent is extended or adjusted under 35 U.S.C. 154(b) by 268 days.

(21) Appl. No.: 09/821,660

(22) Filed: Mar. 29, 2001

(65) Prior Publication Data

US 2002/0138930 A1 Oct. 3, 2002

(51) Int. Cl.[7] ..... A47K 7/02; A61H 7/00

(52) U.S. Cl. ..... 15/110; 15/160; 15/DIG. 5; 4/606

(58) Field of Search ..... 15/DIG. 5, 110, 15/104.92, 160, 161; 4/606

(56) References Cited

U.S. PATENT DOCUMENTS

| | | | | |
|---|---|---|---|---|
| 2,852,793 | A | * | 9/1958 | Shelton |
| 2,901,760 | A | * | 9/1959 | Nelson |
| 2,904,037 | A | | 9/1959 | Cassidy |
| 3,027,568 | A | | 4/1962 | Blau et al. |
| 3,055,357 | A | | 9/1962 | Redka |
| 3,283,756 | A | | 11/1966 | Turley |
| 3,543,747 | A | | 12/1970 | Gustafson |
| 3,548,439 | A | | 12/1970 | Berst |
| 3,973,286 | A | | 8/1976 | Logan |
| 4,384,384 | A | * | 5/1983 | Trojohn |
| D280,868 | S | * | 10/1985 | Russell |
| 5,081,735 | A | * | 1/1992 | Wyatt |
| 5,177,829 | A | | 1/1993 | Simpson |
| 5,588,161 | A | | 12/1996 | Barradas |
| 5,724,695 | A | * | 3/1998 | Galizia |
| 5,729,841 | A | | 3/1998 | Chan |
| 5,729,858 | A | * | 3/1998 | Riffel |
| 5,996,160 | A | * | 12/1999 | Pruitt |
| 5,996,163 | A | * | 12/1999 | Galizia |
| 6,223,379 | B1 | * | 5/2001 | Martin |
| 6,226,811 | B1 | * | 5/2001 | Fagan |
| 6,253,407 | B1 | * | 7/2001 | Bjelkevig |
| 6,370,722 | B1 | * | 4/2002 | Duckworth |
| 6,485,444 | B1 | * | 11/2002 | Gershov |

* cited by examiner

*Primary Examiner*—Randall E. Chin
(74) *Attorney, Agent, or Firm*—Michael F. Krieger; Kirton & McConkie

(57) ABSTRACT

The present invention is directed toward a foot scrubber and massager formed of modular parts. The foot scrubber has a base module that defines a foot print shaped recess. Inside the recess are a number of holes that aid in securing the bristle module and retaining module in the recess. The bristle module corresponds in size and shape to the recess in the base module has bristles extending outward from the bristle module. A securing module secures the bristle module in the base module.

22 Claims, 10 Drawing Sheets

FOOT SCRUBBING AND MASSAGING DEVICE

INTRODUCTION

1. Field of the Invention

The present invention relates to an apparatus for scrubbing, massaging and increasing circulation in the feet. More specifically, the present invention relates to a modular foot scrubbing and massaging device for individuals having impaired circulation in the lower extremities and/or impaired mobility.

2. Background

Certain medical conditions impair a person's blood circulation to his or her lower appendages. This condition is commonly the result of peripheral vascular disease or arteriosclerosis of the extremities. Many diabetics suffer from this condition, having impaired circulation to their lower extremities, and in particular to their feet. As arteriosclerosis progresses in a person's artery, the artery walls thicken and the lumen becomes more narrow, decreasing blood flow and potentially occluding the artery completely. The disorder is common in older people and in individuals with a personal or family history of heart or cerebrovascular disease, diabetes, hypertension, and kidney disease involving hemodialysis. Smoking and obesity also increase the risk. The condition may result in numbness or pain in the extremities, hair loss, and skin slough. In extreme cases, cyanosis, ulcers, gangrene and other infection can result.

A person suffering from impaired circulation may benefit from medical treatment and a measure of self care. Medications are often prescribed and occasionally surgery (such as bypass surgery or angioplasty) is required to treat the disease. In addition to these medical treatments the patient may require self treatments such as specialized exercise to improve circulation and develop collateral vasculature. Specialized foot care may be necessary, particularly if the patient is suffering from diabetes mellitus. The decreased circulation to the person's feet increases the likelihood of infection in the feet. Furthermore, the outer skin layers of these areas of the body may shed or be sloughed off more quickly. Diabetics are often required to more vigorously and frequently scrub their feet in order to remove the outer layers of shedding skin.

To assist in the specialized foot care required by individuals suffering from arteriosclerosis of the lower extremities, a number of circulation enhancing and cleaning devices have been designed. However, these devices do not adequately address the needs of individuals in need of specialized foot care. A number of these devices are designed to either scrub the feet or massage the feet by having the patient hold the instrument in his or her hand and manually scrub or massage the foot. One of the drawbacks of the prior art is that it is generally difficult to keep the device sufficiently clean where the device has multiple parts. Scrubbing type devices with bristles or brushes often trap and maintain dead skin and oils, which are not readily rinsed off. Maintaining the device in a clean and preferably sterile condition, which is important under normal circumstances, is particularly important given how susceptible to infection a person suffering from arteriosclerosis in the lower extremities can be.

Another drawback of the prior art is that prior art devices can be difficult to use by elderly patients, who make up a good part of those suffering from arteriosclerosis. Instruments that require the user to lean over and scrub or massage the feet may be difficult to use for those who have impaired mobility. Hand-held devices may require the user to exert a level of upper body strength not typically found in elderly people. Other devices are too heavy or bulky for those who are with impaired mobility to handle.

It would be advantageous to provide a device for scrubbing and massaging feet designed to address the needs of individuals suffering from poor circulation in their lower extremities.

SUMMARY AND OBJECTS OF THE INVENTION

The present invention is a foot massaging and scrubbing device to stimulate circulation in the feet and facilitate the scrubbing of feet for individuals who have restricted blood flow in their lower appendages. One advantage of the present invention is its modular configuration. The apparatus has a base module that is designed to be water resistant and is designed to not slip on wet floors. The base has a footprint-shaped recess into which the massaging and scrubbing bristles, the second module of the apparatus, can be inserted. The base also contains a series of fin-like projections along a portion of the footprint-shaped recess. The finned portions provide both scrubbing and massaging effects to the user's foot when the user places his or her foot into the recess. The base has a wide surface area to give the base both stability and a broad surface area for increased friction to enhance its non-slip characteristics.

The bristle module fits into the footprint shaped recess within the base module and provides a variety of bristle patterns, shapes, and sizes. A bristle module having a variety of bristle patterns, shapes, and sizes design can be replaced by bristle module having a different variety of bristle patterns, shapes, and sizes, according to the user's preference and needs. For example, one style of bristle module may have more bristles per square inch than another. Unique "bristle projections" provide massaging and scrubbing actions along the sides of the foot. In one preferred embodiment, the bristle module has three types of bristles at different positions having different shapes, thickness, lengths, flexibility, and densities. The tips of the bristles collectively form an initial contact surface of the bristle module. The contact surface of the bristle module may be shaped to correspond to the shape and contours of the sole of a user's foot. Alternative configurations of the bristle module are anticipated, such as configurations including abrasive surfaces, pumice stones, or loofah scrubs in the bristle module. The removable bristle module also allows the bristles to be more easily cleaned and for the module to be replaced as necessary.

A third component, the securing module, secures the bristles firmly within the footprint shaped recess. In a preferred embodiment, the securing module has poppettes or tabs that are inserted through corresponding holes in the bristle module and bristle base.

In an alternative embodiment, cleaning agents and moisturizers may be released from the apparatus into the footprint-shaped recess and surrounding area and onto the user's foot. The device has multiple apertures that allow for the drainage of water from the recess in the base, which facilitate use of the apparatus in the shower or bathtub. A user of the device can place the device in the shower or bathtub and placing his or her foot on the bristles in the footprint-shaped recess can effectively massage and scrub the foot without having to bend over, an important benefit to individuals who may be in some way impaired in their mobility.

BRIEF DESCRIPTION OF THE DRAWINGS

The foregoing and other objects and features of the present invention will become more fully apparent from the accompanying drawings when considered in conjunction with the following description and appended claims. Although the drawings depict only typical embodiments of the invention and are thus not to be deemed limiting of the invention's scope, the accompanying drawings help explain the invention in added detail, wherein:

DETAILED DESCRIPTION OF THE PREFERRED EMBODIMENTS

The figures listed above are expressly incorporated as part of this detailed description.

It is emphasized that the present invention, as illustrated in the figures and description herein, can be embodied or performed in a wide variety of ways. Thus, neither the drawings nor the following more detailed description of the various embodiments of the system and method of the present invention limit the scope of the invention. The drawings and detailed description are merely representative of the particular embodiments of the invention; the substantive scope of the present invention is limited only by the appended claims. The various embodiments of the invention will be best understood by reference to the drawings, wherein like elements are designated by like alphanumeric characters throughout.

Figure 1:
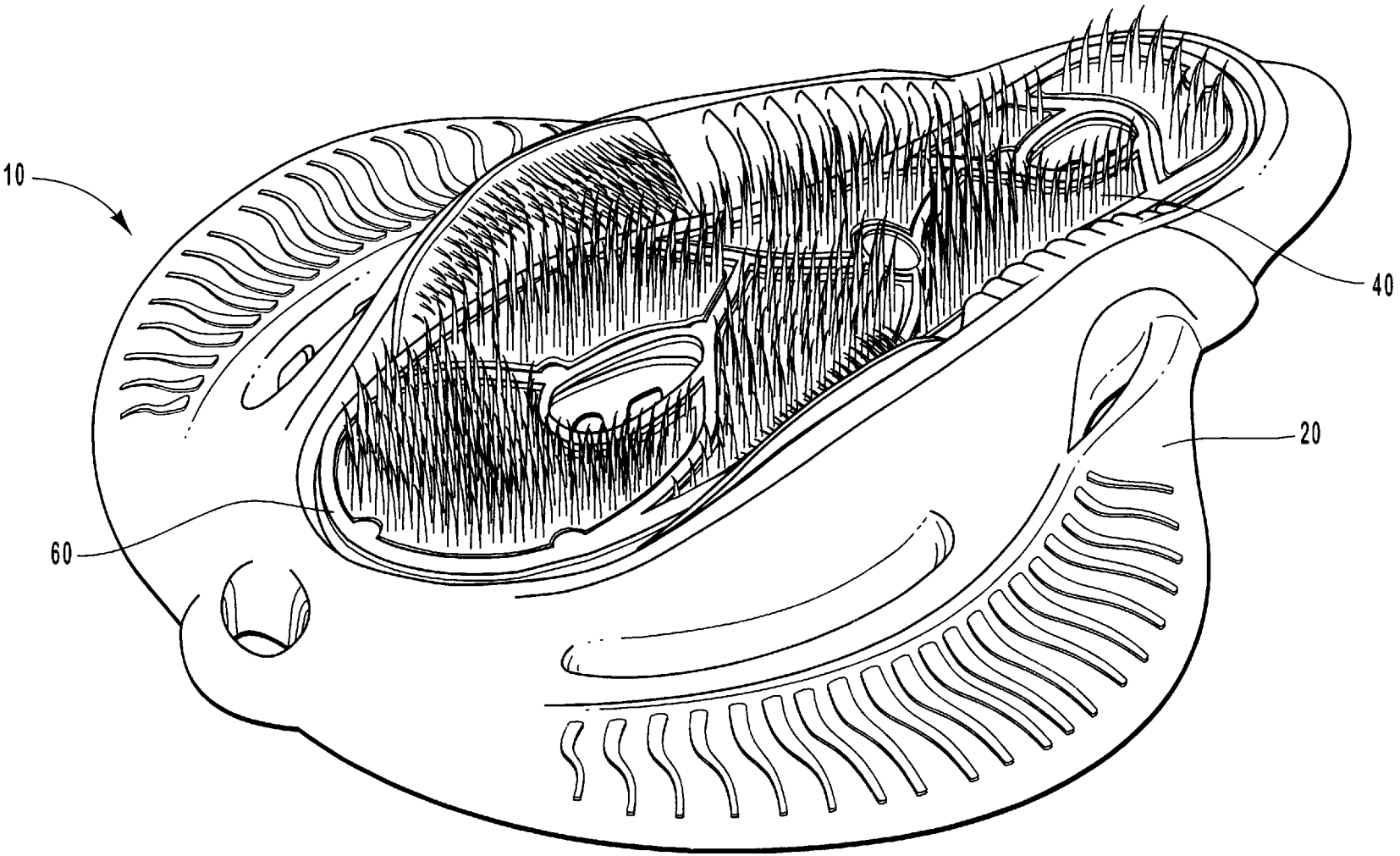
FIG. 1 shows a perspective view of the present invention.
Figure 2:
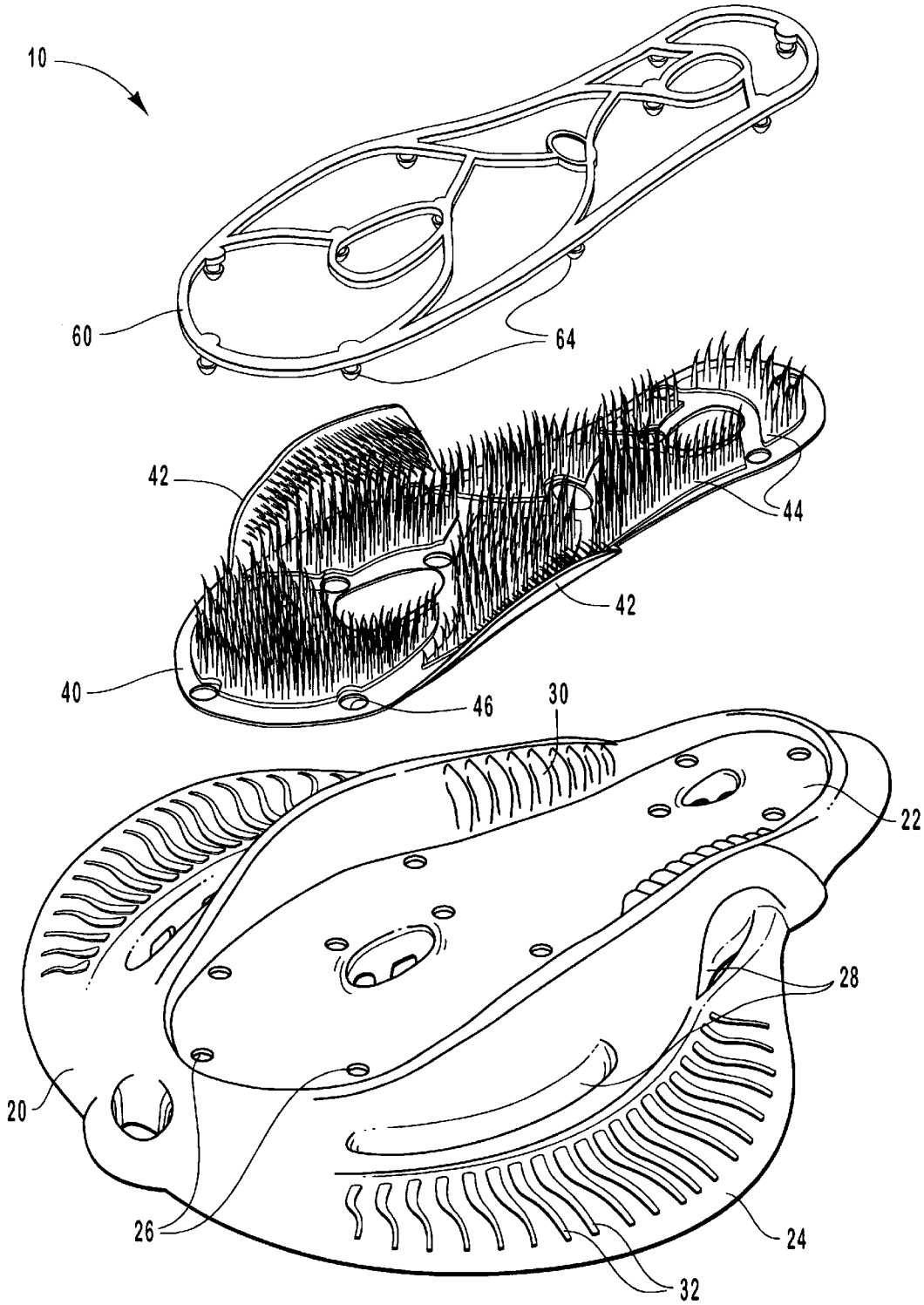
FIG. 2 shows an exploded perspective view of the embodiment in FIG. 1.
Figure 3:
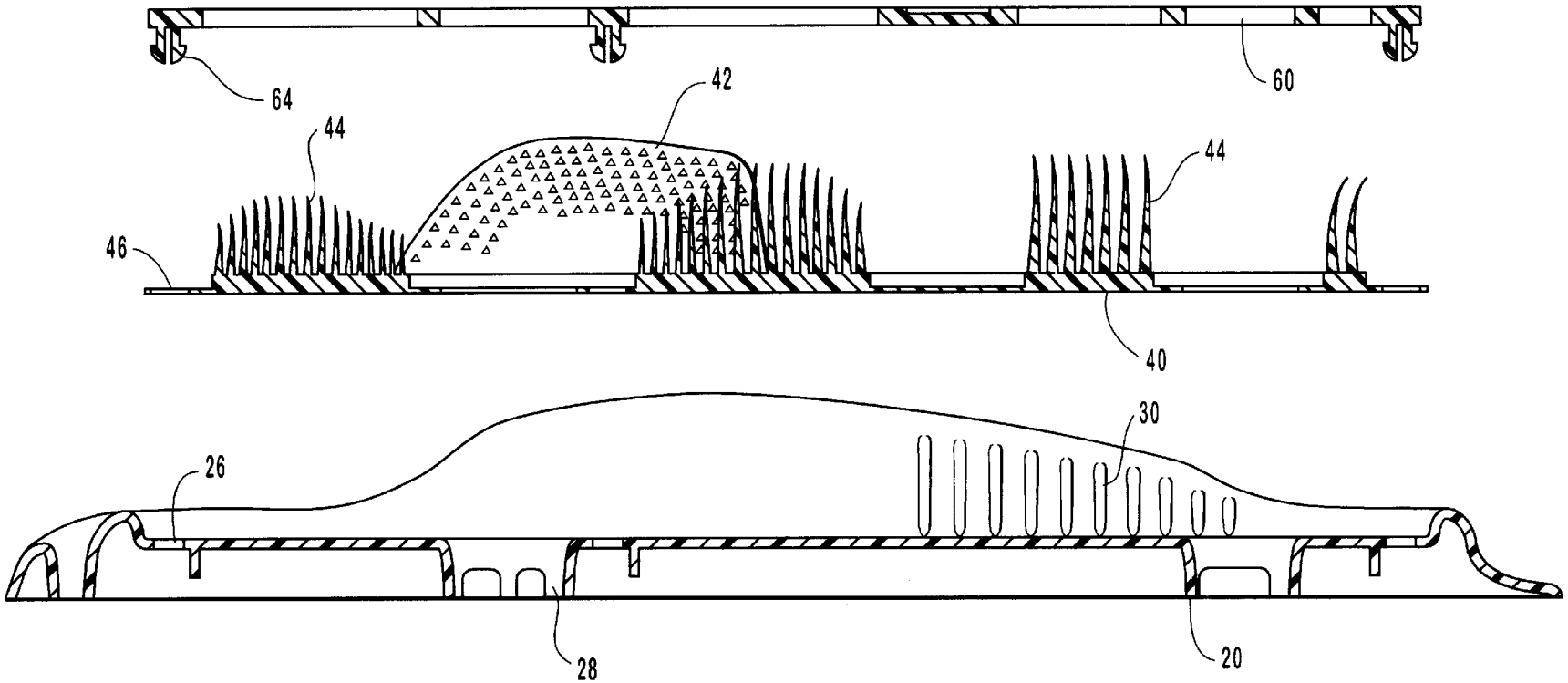
FIG. 3 shows a cross-sectional side view of one embodiment of the present invention.

As shown in FIGS. 1, 2 and 3, the present invention is a foot scrubber 10 comprising a base module 20, a bristle module 40, and a securing module 60. Specifically, FIG. 2 shows an exploded view of foot scrubber 10 with base module 20, bristle module 40, and securing module 60 in alignment to be secured. The modular construction of foot scrubber 10 allows foot is scrubber 10 to be easily disassembled and cleaned. Because of the potential risk of infection of individuals who have arteriosclerosis of the lower extremities, it is critical that any device that comes into contact with the foot be clean and preferably sterile. In order to properly clean sloughed skin and body oils from any foot scrubbing device, it is advantageous to be able to separate the various portions of the device and clean them individually. Additionally, the modular construction allows for variation in the bristle module 40 or additional attachment to allow for the customizing of foot care.

Base module 20 defines a recess 22 capable of receiving bristle module 40. Recess 22 and bristle module 40 correspond in size and shape such that bristle module 40 is capable of being secured within a recess 22. Within recess 22, base module 20 additionally defines a plurality of holes 26. Holes 26 extend through the base module 20. Holes 26 receive and releasably secure poppets 64 on the securing module 60, as explained in additional detail below. Base module 20 additionally defines a plurality of drainage apertures 28. Drainage apertures 28 extends completely through base module 20 and allow liquid on the upper surface of base module 20 to drain off of the surface, into apertures 28 and under and away from base module 20. Apertures 28 facilitate the use of the present invention in conjunction with water, steam, lotions, oils, or other fluids that could build up on the surface of base module 20.

Protrusion ribs 30 are disposed about recess 22. Protrusion ribs 30 provide additional massaging and scrubbing stimulation of a user's foot. Base module 20 additionally comprises a base wing 24. Base wing 24 extends laterally from base module 20 and is substantially flat. A plurality of foot grips 32 extend upwardly from the surface of base wing 24. Base wing 24 helps to secure the invention to the floor in two ways when the invention is in use. First, by increasing the contact surface of the present invention with the floor, base wing 24 creates additional friction and inertia to prevent foot scrubber 10 from moving when in use. Second base wing 24 also provides a large, flat contact surface onto which the user may step with the foot that is not being scrubbed. The weight of the user on base wing 24 additionally secures foot scrubber 10 to the floor and prevents its moving during use.

The perimeter of bristle module 40 is substantially footprint shaped, corresponding to recess 22 in base module 20. A plurality of bristles 44 extend upwardly from the surface of bristle module 40. Bristles 44 may have a variety of lengths, shapes, and sizes and may be designed in a number of patterns according to the user's preferences and needs. Bristles 44 may have varying shape thickness and flexibility. The pattern of bristles 44 as disposed upon bristle module 40 may also vary depending upon the needs of the user.

Figure 4:
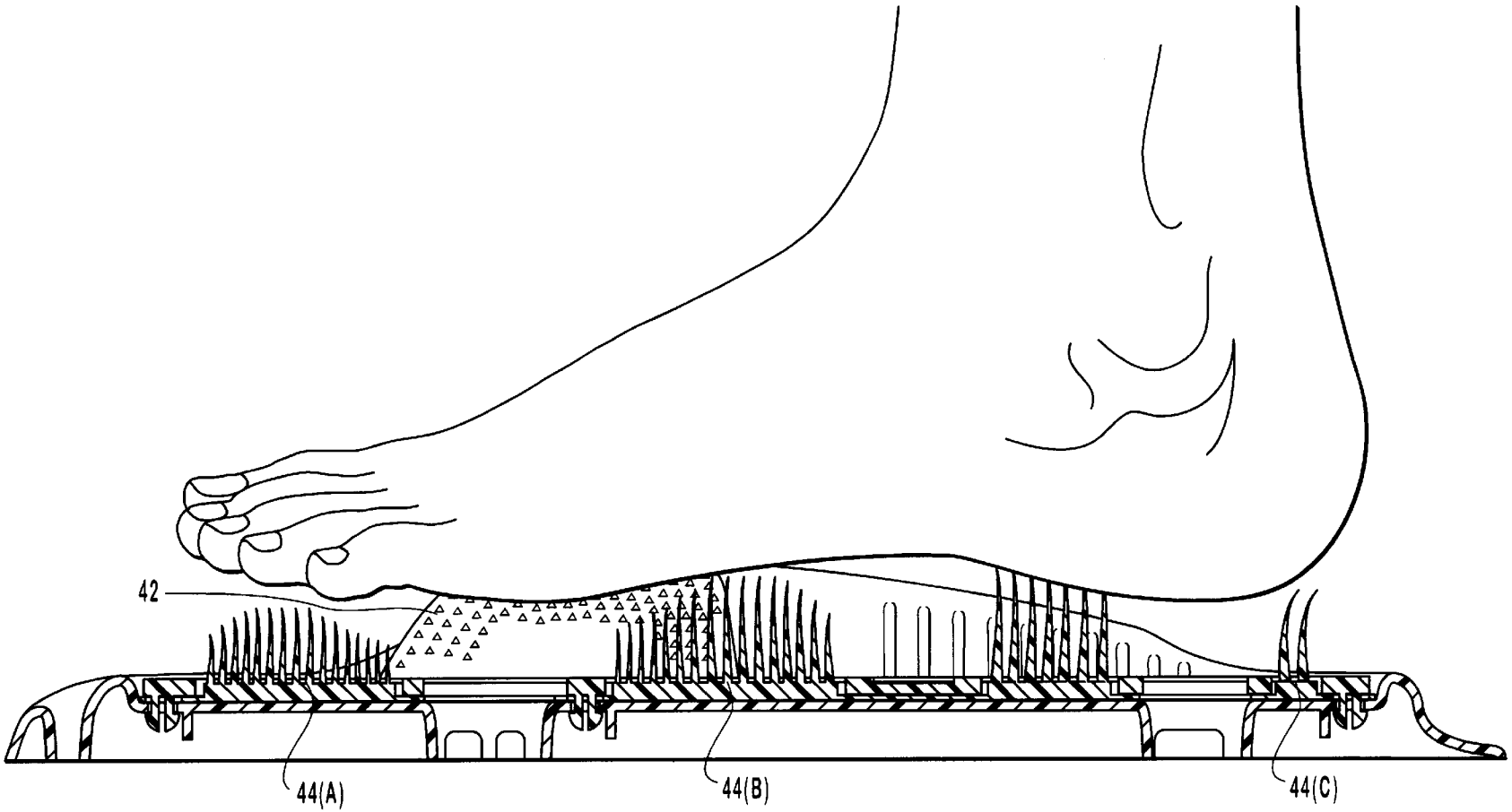
FIG. 4 shows a cross sectional side view of one embodiment of the present invention in use.

In order to secure bristle module 40 to base module 20 as shown in FIG. 4, a securing module 60 is provided. Securing module 60 is a ring having a plurality of poppets disposed thereon. Poppets 64 extend from the ring outwardly and are disposed on the ring in positions that correspond to holes 46 in bristle module 40 and holes 26 in base module 20. Poppet 64 can be inserted through holes 46 and holes 26 so as to secure bristle module 40 into recess 22 of base module 20. Alternatively, other means for securing may be used such as loop and hook fasteners or snaps. Use of a securing module 60 is advantageous in that while the user is scrubbing his or her foot against the bristles 44 of bristle module 40, the securing module does not receive direct pressure from the user's foot, which allows the poppets 64 to remain more secure within holes 46 and holes 26.

FIG. 4 shows bristles 44(A)(B), and (C), having different shapes, flexibility, and length. A plurality of holes 46 extend through bristle module 40 and correspond in relative position to holes 26 in base module 20. Bristle module 40 may further comprise one or more projections 42. Projections 42 also have bristles 44 extending from the surface of projection 42, however, projection 42 is placed along the perimeter of bristle module 40 allowing bristles 44 on extension 42 to contact the side of a user's foot when foot scrubber 10 is in use. In a preferred embodiment, projection 42 is located at a position on bristle module 40 that allows bristles 44 to contact a user's foot near the user's arch.

Figure 5:
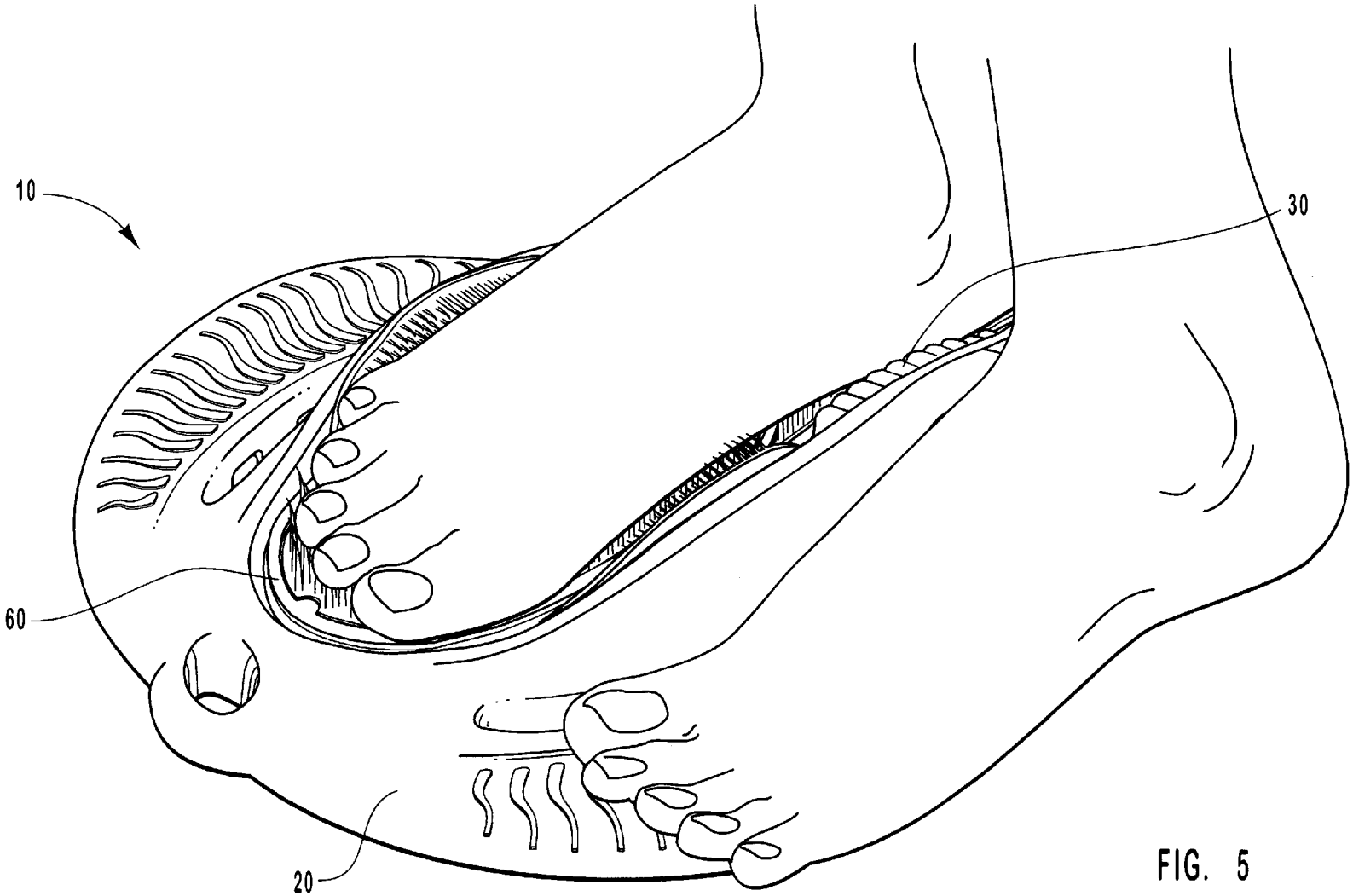
FIG. 5 shows a perspective view of one embodiment of the present invention in use.

FIGS. 4 and 5 show the foot scrubber 10 in use. Foot scrubber 10 is placed on the floor with the bristle module 40 secured in recess 22 of base module 20. The user places his or her foot on bristle module 40 and moves the foot back and forth allowing bristles 44 to scrub the foot. Additionally, protrusion ribs 30 may massage and scrub the foot and bristles 44 on projection 42 may massage and scrub the side of the user's foot. In embodiments containing other scrubbing devices, such as pumice stones within bristle module 40, the user can adjust the pressure of the foot on the alternative scrubbing device and thereby customize the type of scrubbing applied to a particular part of the foot. Likewise, with attachments such as massaging bumps attachment 70, pumice attachment 100, loofah attachment, and abrasive sponge attachment or, the user can remove his or her foot from the bristle module 40 and place it on the attachment and move his or her foot across the attachment to provide more customized foot care.

Figure 6:
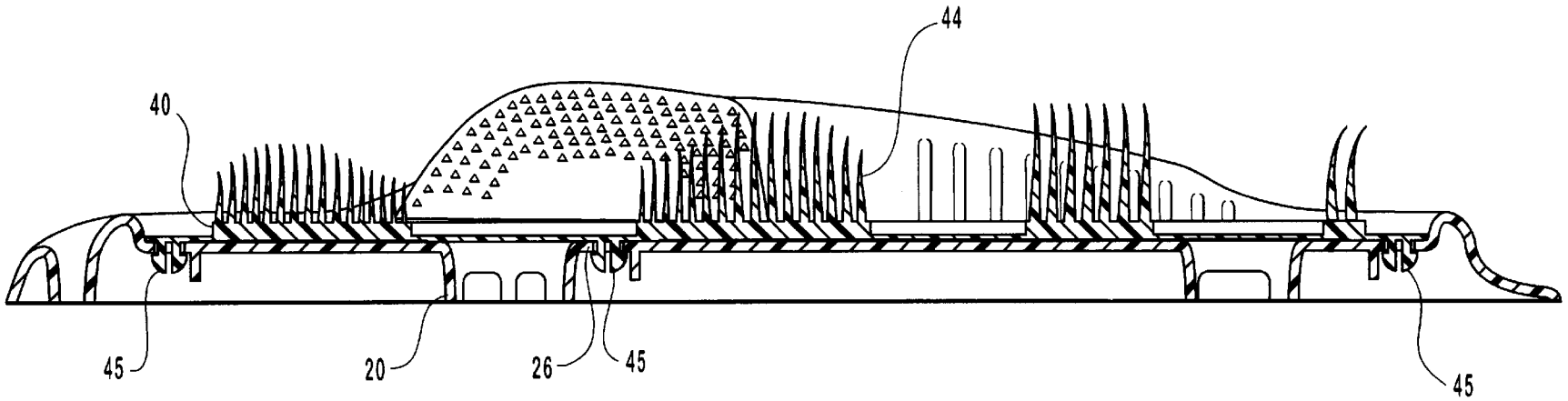
FIG. 6 cross-sectional side view of another embodiment of the present invention with poppets disposed on the bristle module.

In an alternative embodiment, shown in FIG. 6, bristle module 40 has a plurality of poppets 45 for securing the bristle module 40 to the base module 20. Poppets 45 correspond in relative position to the base holes 26, obviating the need for a separate securing module or ring.

Figure 7:
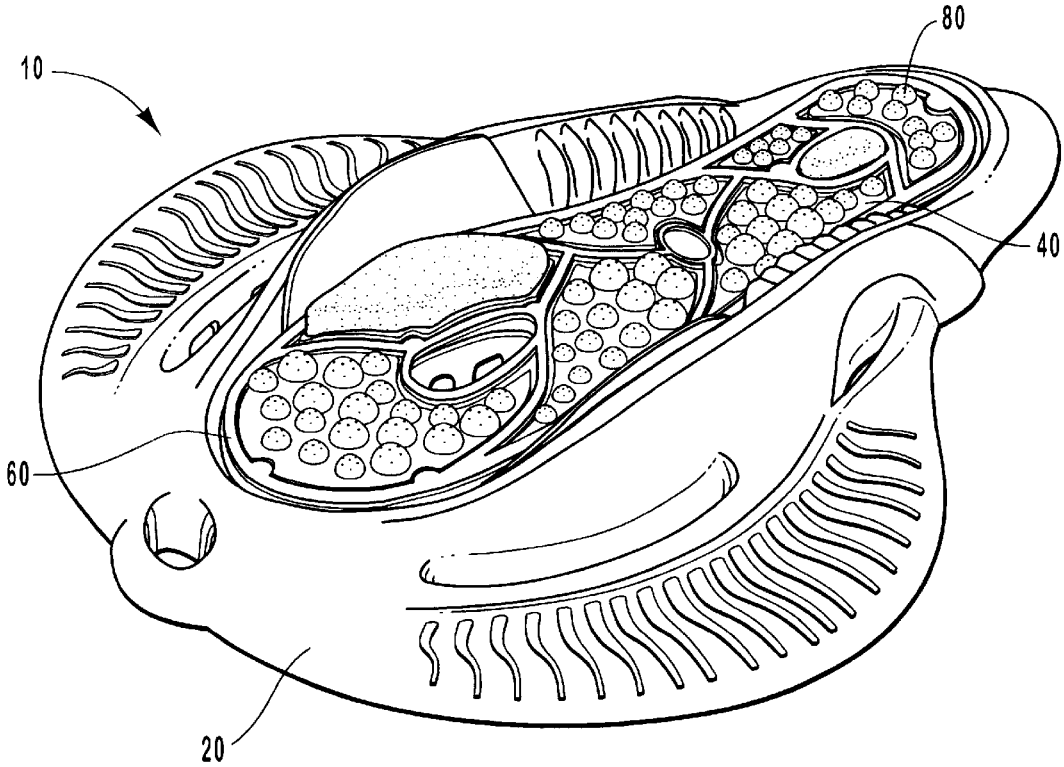
FIG. 7 shows a perspective view of one embodiment having a reflexology bump module.
Figure 8:
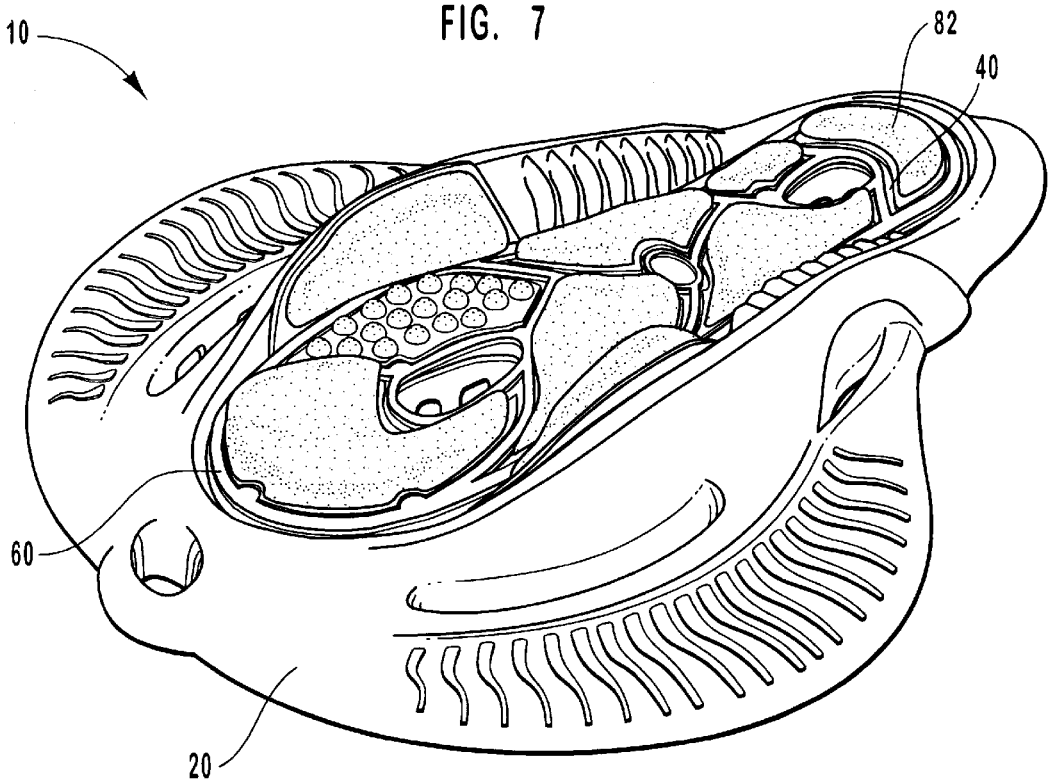
FIG. 8 shows a perspective view of one embodiment having a pumice stone in the bristle module.

In addition or an alternative to bristles 44, bristle module 40 may include various scrubbing devices such as a reflexology bumps 80 or pumice stone 82, as shown in FIGS. 7 and 8, or an abrasive sponge or loofah (not shown).

Figure 9:
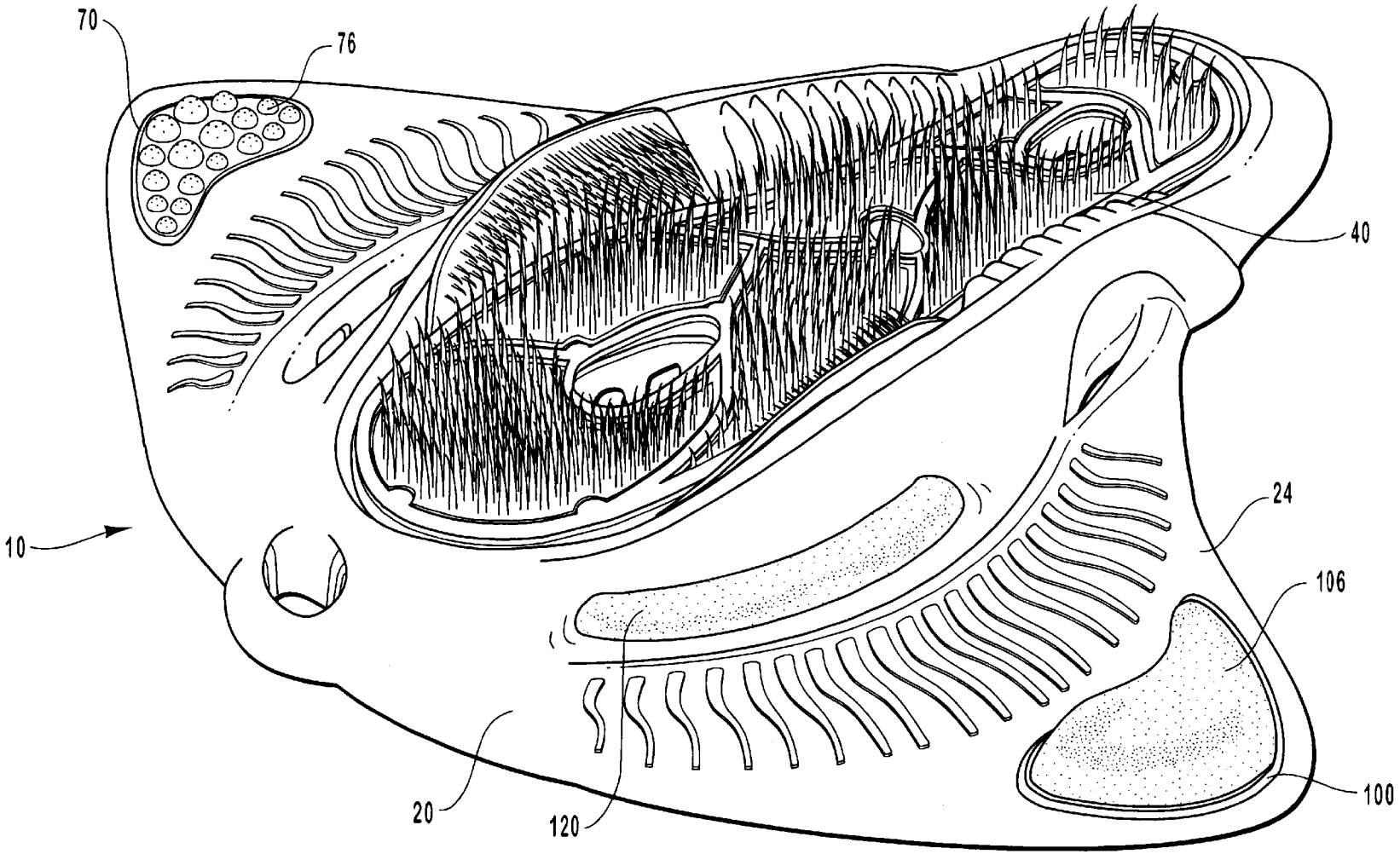
FIG. 9 shows another embodiment of the present invention having extended base wings with a base wing pumice stone module and a base wing reflexology bump module.

In one alternative embodiment of the present invention, shown in FIG. 9, base wings 24 are provided with an additional attachment allowing the user to customize foot care. For example, massage reflexology bump attachment 70 having a base and a plurality of poppets may be attached to base wing 24 through base wing holes. A plurality of massaging bumps 76 on attachment 70 extend upwardly from base wing 24. Likewise, a loofah attachment (not shown) or an abrasive sponge attachment (not shown) may likewise be disposed upon base wing 24. Similarly, pumice attachment 100 comprises a base with a plurality of poppets, and a pumice stone 106 secured to the base. Other attachments, such as pumice inset 120, can optionally be attached into one or more of the drainage apertures.

Figure 10:
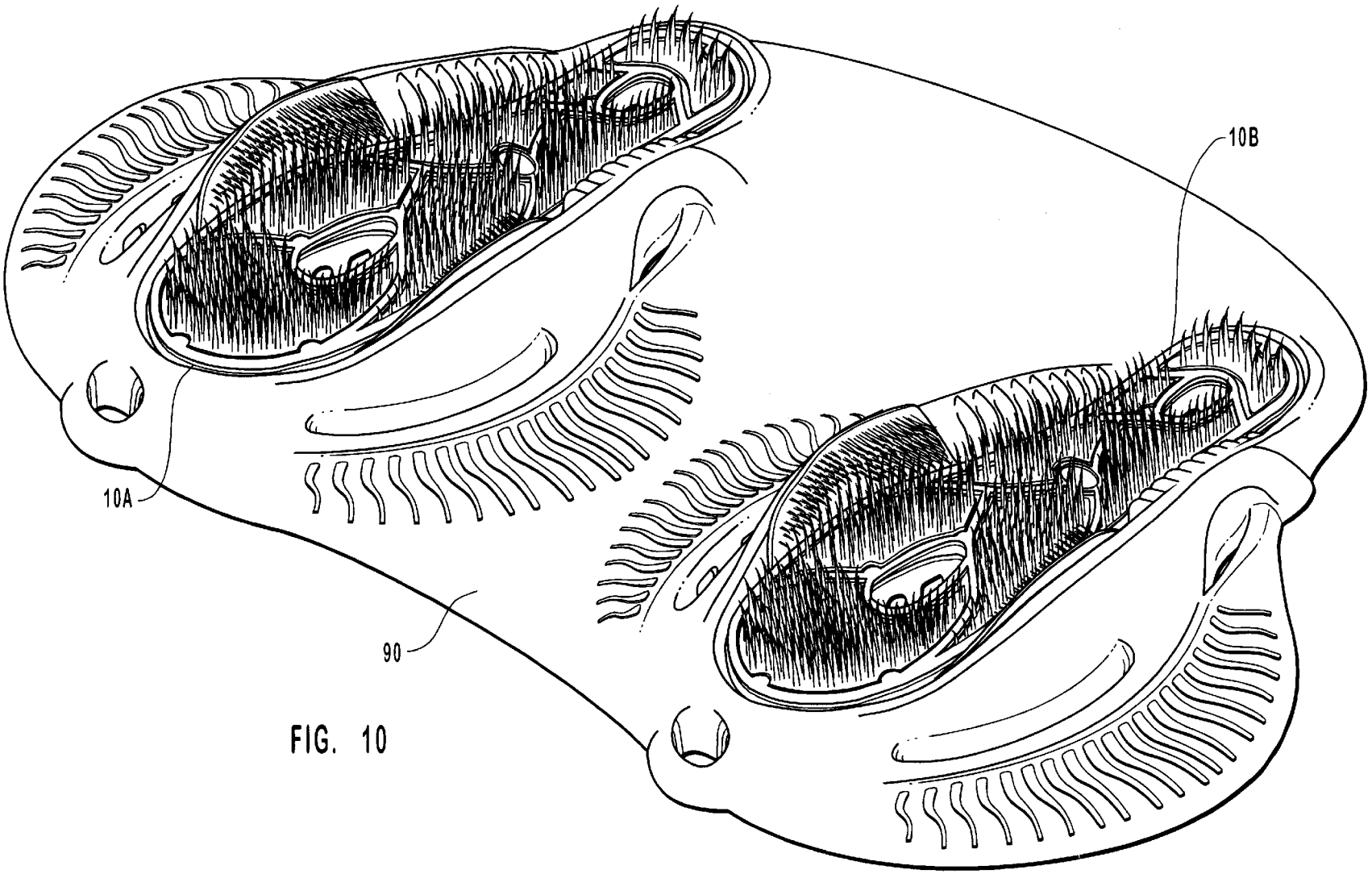
FIG. 10 shows a perspective view of a mat having two foot-scrubbers disposed therein.
Figure 11:
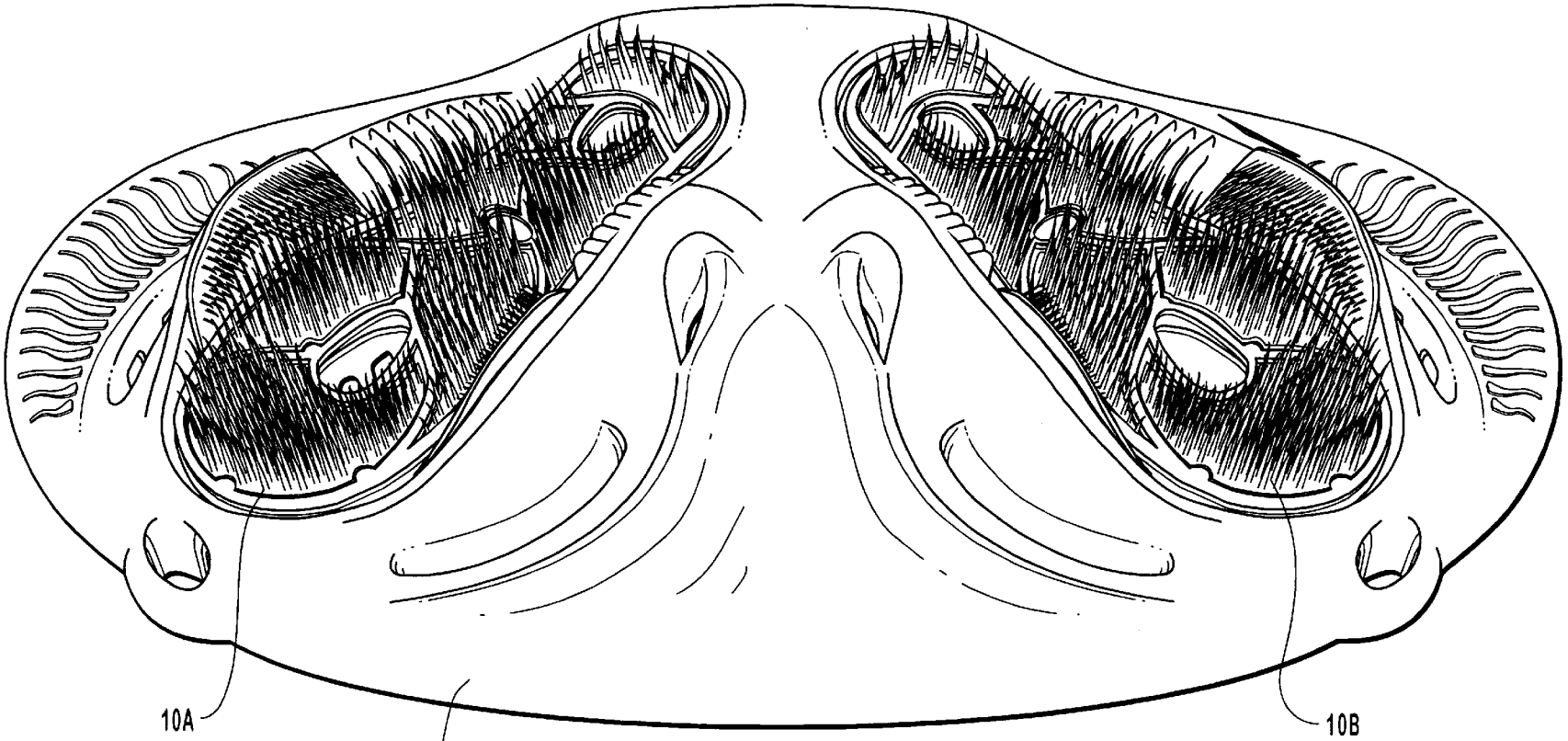
FIG. 11 shows a perspective view of another mat having two foot-scrubbers disposed therein.

Attachments such as massaging bump attachment 70, pumice attachment 100 and loofah attachment, and abrasive sponge attachment, and all provide the user with the ability to customize foot care by selecting one or more of the attachments and securing the attachment to base module 20. While using foot scrubber 10, the user can alternate between scrubbing the foot on bristle module 40 and employing one of the additional attachments. In other alternative embodiments, an attachment or bristle module may include all or combination of the scrubbing and massaging elements described. FIGS. 10 and 11 illustrate different embodiments of multiple foot scrubber devices 10A and 10B incorporated into a single rubber mat 90.

The present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A foot scrubber comprising:

a base module having an upper and a lower surface, wherein said base module is configured to cradle and substantially conform to a foot; and a customizable bristle module, said bristle module capable of being secured to said upper surface of said base module and said bristle module having a plurality of bristles extending outward from said bristle module, wherein said customizable bristle module may be customized to accommodate at least one of a plurality of interchangeable attachments.

2. The foot scrubber of claim 1, wherein said base module further comprises a base wing.

3. The foot scrubber of claim 1, wherein said bristle module is secured to said base module using a securing module, said securing module having a plurality of downwardly projecting poppets capable of passing through a plurality of holes defined by said bristle module and through a plurality of corresponding base module holes.

4. The foot scrubber of claim 1, wherein said base module further comprises apertures for drainage.

5. The foot scrubber of claim 1, wherein said base module further comprises a plurality of protrusion ribs.

6. The foot scrubber of claim 1, wherein said base module further comprises a foot grip.

7. The foot scrubber of claim 1, wherein said bristle module has a plurality of bristles of varying lengths, width, and strength.

8. A modular foot scrubber comprising:

a base module defining a recess and a plurality of holes within said recess;

a bristle module having a shape corresponding to said recess in said base module defining a plurality of bristle module holes, said holes corresponding in size and position to said base module holes and said bristle module having a plurality of bristles extending outward from said bristle module;

a securing module for securing said bristle module in said base module, wherein a plurality of poppets extend downwardly from said securing module, said plurality of poppets corresponding in size and relative position to the bristle module holes and base module holes and capable of passing through said bristle module holes and base module holes to secure the bristle module to the base module.

9. The foot scrubber of claim 8, wherein said base module further comprises a wing defining a plurality of wing holes; and an application attachment having an application attachment base from which a plurality of poppets corresponding in size and shape to the wing base holes extend downwardly, said poppets capable of securing said application attachment to said base wing.

10. The foot scrubber of claim 9, wherein said application attachment is a reflexology bump attachment.

11. The foot scrubber of claim 8, wherein said bristle module further comprises a pumice stone disposed within the bristle module.

12. The foot scrubber of claim 8, wherein said bristle module further comprises a loofah disposed within said bristle module.

13. The foot scrubber of claim 8, wherein said bristle module further comprises an abrasive sponge disposed within said bristle module.

14. The foot scrubber of claim 8, wherein said bristle module further comprises massaging bumps disposed within said bristle module.

15. The foot scrubber of claim 8, wherein said base module futher comprises apertures for drainage.

16. The foot scrubber of claim 8, wherein said base module further comprises a plurality of protrusion ribs.

17. The foot scrubber of claim 8, wherein said base module further comprises a foot grip.

18. The foot scrubber of claim 8, wherein said bristle module has a plurality of bristles of varying lengths, width, and strength.

19. The foot scrubber of claim 9, wherein said application attachment is a loofah attachment.

20. The foot scrubber of claim 9, wherein said application attachment is an abrasive sponge attachment.

21. The foot scrubber of claim 9, wherein said application attachment is a pumice stone attachment.

22. The foot scrubber of claim 9, wherein said additional application is secured to said base module using an application attachment securing module, said securing module having a plurality of downwardly projecting poppets capable of passing through a plurality of application attachment holes defined by said application attachment and through a plurality of corresponding base wing holes.

* * * * *